US012680227B2

(12) United States Patent
Campos De Araújo Mesquita Da Silveira et al.

(10) Patent No.: US 12,680,227 B2
(45) Date of Patent: Jul. 14, 2026

(54) BREATHABLE LAYERED FLEXIBLE MATERIAL, METHODS AND USES THEREOF

(71) Applicant: TMG TECIDOS PLASTIFICADOS E OUTROS REVESTIMENTOS PARA A INDUSTRIA AUTOMOVEL SA, São Cosme Vale (PT)

(72) Inventors: Gonçalo Campos De Araújo Mesquita Da Silveira, São Cosme Vale (PT); Joana Isabel Lopes Mota, São Cosme Vale (PT); Ana Catarina De Bastos Vidal Dias, São Cosme Vale (PT); José Luis Lamego, São Cosme Vale (PT); Elizabete Peixoto Pinho, São Cosme Vale (PT); Ilídio Pinto, São Cosme Vale (PT)

(73) Assignee: TMG Tecidos Plastificados e Outros Revestimentos Para a Industria Automovel SA, São Cosme Vale (PT)

( * ) Notice: Subject to any disclaimer, the term of this patent is extended or adjusted under 35 U.S.C. 154(b) by 274 days.

(21) Appl. No.: 18/245,361

(22) PCT Filed: Sep. 30, 2021

(86) PCT No.: PCT/IB2021/059008
§ 371 (c)(1),
(2) Date: Mar. 15, 2023

(87) PCT Pub. No.: WO2022/070135
PCT Pub. Date: Apr. 7, 2022

(65) Prior Publication Data

US 2023/0357986 A1 Nov. 9, 2023

(30) Foreign Application Priority Data

Oct. 2, 2020 (PT) ..... 116808
Oct. 8, 2020 (EP) ..... 20200877

(51) Int. Cl.
*D06N 3/00* (2006.01)
*D06N 3/08* (2006.01)

(52) U.S. Cl.
CPC ..... *D06N 3/0043* (2013.01); *D06N 3/0056* (2013.01); *D06N 3/0097* (2013.01);
(Continued)

(58) Field of Classification Search
CPC ..... B32B 2250/02; B32B 2255/10; B32B 2255/26; B32B 2264/10;
(Continued)

(56) References Cited

U.S. PATENT DOCUMENTS 3,520,836 A 7/1970 Spielau
4,336,300 A * 6/1982 Lorant ..... D06N 3/065 427/244

(Continued)

FOREIGN PATENT DOCUMENTS

CN 111607980 A 9/2020
DE 1018837 B 11/1957

(Continued)

OTHER PUBLICATIONS

Translation of KR20180091173A, Park et al., Aug. 26, 2018. (Year: 2018).*

(Continued)

*Primary Examiner* — Hai Vo
(74) *Attorney, Agent, or Firm* — Leason Ellis LLP

(57) ABSTRACT

The present disclosure relates to a breathable layered flexible material comprising at least one polyvinyl chloride (PVC) porous layer or a plurality of PVC porous layers and a support layer. The pores of the PVC porous layer or plurality of PVC porous layers are obtainable by water evaporation of a water-in-oil PVC emulsion. The pores extend from the PVC layer to the support layer providing the (Continued)

material breathability. The disclosure also relates to a method for preparing the breathable layered flexible material. Upholsteries, in particular car upholsteries, comprising the breathable layered flexible material are also disclosed.

10 Claims, 2 Drawing Sheets

(52) U.S. Cl.
CPC ..... *D06N 3/08* (2013.01); *D06N 2203/048* (2013.01); *D06N 2203/068* (2013.01); *D06N 2209/0823* (2013.01); *D06N 2209/0876* (2013.01); *D06N 2209/123* (2013.01); *D06N 2209/126* (2013.01); *D06N 2213/03* (2013.01)

(58) Field of Classification Search
CPC .... B32B 2264/1051; B32B 2264/1052; B32B 2264/1055; B32B 2307/416; B32B 2307/724; B32B 27/20; B32B 27/304; B32B 3/266; B32B 5/022; B32B 5/024; B32B 5/026; B32B 5/18; B32B 5/245; B32B 7/12; D06N 2203/048; D06N 2203/068; D06N 2209/0823; D06N 2209/0876; D06N 2209/123; D06N 2209/126; D06N 2213/03; D06N 3/0043; D06N 3/0056; D06N 3/0059; D06N 3/0063; D06N 3/0065; D06N 3/0095; D06N 3/0097; D06N 3/06; D06N 3/08
See application file for complete search history.

(56) References Cited

U.S. PATENT DOCUMENTS

| | | | | |
|---|---|---|---|---|
| 9,732,199 | B2 | 8/2017 | Neumann et al. | |
| 2018/0345634 | A1* | 12/2018 | Schaefer | B32B 3/266 |

FOREIGN PATENT DOCUMENTS

| | | | | |
|---|---|---|---|---|
| EP | 3034687 | A1 | | 6/2016 |
| KR | 20180091173 | A | * | 8/2018 |
| WO | 2014150846 | A1 | | 9/2014 |

OTHER PUBLICATIONS

International Search Report for corresponding PCT Application No. PCT/IB2021/059008 completed on Jan. 19, 2022.

* cited by examiner

BREATHABLE LAYERED FLEXIBLE MATERIAL, METHODS AND USES THEREOF

CROSS-REFERENCE TO RELATED APPLICATIONS

This application is a U.S. National Application under 35 U.S.C. § 371 of International Application No. PCT/IB2021/059008, filed Sep. 30, 2021, which claims priority to Portugal Patent Application No. 116808, filed Oct. 2, 2020 and European Patent Application No. 20200877.7 filed Oct. 8, 2020, the contents of which are each hereby incorporated by reference in their respective entireties.

TECHNICAL FIELD

The present disclosure relates to a flexible material with improved comfort, in particular a flexible upholstery material for upholstering seating area.

The flexible material of the present disclosure may be used in car seat upholstery where there is a growing need for artificial leather which provides similar comfort to the user other than the solutions available in the market—e.g., Alcantara, natural leather, textiles. However, these kinds of products can be used in all types of markets that require materials with superficial aspect and touch of natural leather and with improved comfort.

BACKGROUND

In the automotive industry, one of the growing trends is the passenger thermal comfort where the seat is the most important interface between the passenger and the car. The seat thermal comfort is a combination of moisture diffusion, temperature and heat flows in the interface. Sweating is the physiological response of human to an environment perceived as hot and it has a regulating effect. This regulatory mechanism is disturbed when the seat obstructs the water vapour on its way from the skin to the surroundings.

The perception of discomfort depends on the degree of skin wetness which results from the moisture build-up in the interface between the passenger skin and the seat. To enhance the flow of water vapour from the skin to the environment it is crucial to have a backing layer with a high absorption-desorption capacity.

The document U.S. Pat. No. 9,732,199 describes a method for producing a breathable film based on polyvinyl chloride (PVC), including the following steps: preparing a paste-like compound including a first fraction composed of PVC, a second fraction composed of a foreign material (i.e polyurethane, PU), and a third fraction composed of adjuvants and/or additives that are mixed together to form the paste-like compound; applying the paste-like compound to a base, and drying and gelling the paste-like compound, which has been applied to the base, through the addition of heat, thus forming the film in which pores extending from the one surface of the film to the other are formed, which give the film breathability.

The document EP3034687 describes a layered flexible material for coatings that allows the thermal comfort improvement of artificial leather materials, namely upholsteries, by increasing breathability and moisture management of its surfaces. The disclosure is particularly relevant in the automotive sector, namely for automotive upholstery coating.

The document EP2970678 describes a pigment wherein the pigment includes a platy substrate or uniform platy substrate coated with an odd number of layers of alternating layers of high or low refractive index material. Processes for making and using the pigments are also disclosed. These pigments can find application in paints, plastics, cosmetics, glass, printing inks, and glazes.

Document DE 1018837 discloses a fabric coated with a plasticizer-containing pigmented polyvinyl chloride paste which contains dioctyl phthalate and dye and polyvinyl chloride.

Document U.S. Pat. No. 3,520,836 discloses an artificial leather comprising a textile support and a porous PVC layer, a plasticizer, polyvinylchloride and ammonium carbonate or bicarbonate.

Document CN111607980 discloses a perforate artificial leather with cooling and air permeability comprising a base cloth layer, a PVC adhesive layer, a PVC foam layer, a PVC dense layer and a surface layer. An infrared reflection pigment is comprised in the PVC foam layer and in the PVC dense layer.

These facts are disclosed in order to illustrate the technical problem addressed by the present disclosure.

GENERAL DESCRIPTION

An aspect of the present disclosure comprises an innovative solution of artificial leather with heat management capacity, for improved comfort, avoiding the unesthetic appearance caused by the usual mechanical perforation.

To improve the diffusion and heat flows through PVC artificial leather, structural channels were created, adding breathability and moisture management characteristics to the artificial leather.

The reason for a dark coloured surface to heat up is the interaction of the surface with the near infrared-radiation (NIR) emitted by the sun. When radiation is absorbed, light is physically converted into heat that can result in a severe build-up of heat. The development of materials with infrared radiation reflection/transparency capacity allows an improved management of superficial heat when exposed to direct sunlight, avoiding overheating.

Surprisingly, the material described in the present disclosure displays a porous and breathable structure that can be obtained without using harmful blowing agents such as azodicarbonamide (ADCA), expandable microspheres, sodium bicarbonate, amongst many others. These blowing agents, namely azodicarbonamide (ADCA), have been categorised as Substance of Very High Concern (SVHC) and were entirely substituted by a non-solvent in the present subject matter.

In an embodiment, the breathable layered flexible material described may further comprise a PVC foam layer wherein the porous structure is obtainable by using blowing agents, including azodicarbonamide (ADCA), expandable microspheres, sodium bicarbonate, or others.

In an aspect of the present disclosure, it was possible to substantially reduce the weight of the final material, which is a megatrend in the automotive interiors industry. Since the PVC mixtures (plastisol) used to produce the films have a significant water content, further evaporation of water reduces the weight of the material, rendering a final lightweight material.

The present disclosure relates to a breathable layered flexible material comprising at least one polyvinyl chloride-PVC-porous layer or a plurality of PVC porous layers; and a support layer; wherein the pores of said PVC porous layer or plurality of PVC porous layers are obtainable by water evaporation of a water-in-oil PVC emulsion; and wherein the pores extend from the PVC layer to the support layer, providing the material breathability.

An aspect of the present disclosure relates to a breathable layered flexible material comprising at least one polyvinyl chloride-PVC-porous layer or a plurality of PVC porous layers;

a support layer; and an external water permeable lacquer layer over the PVC porous layer or over the plurality of PVC porous layers;

comprising at least 0.1% (wt/wt) of NIR reflective pigments, transparent pigments, or mixtures thereof, wherein the NIR reflective pigments and/or the transparent pigments are in the external permeable lacquer layer, or in the PVC porous layer, or in the plurality of PVC porous layers;

wherein the pores of said PVC porous layer or plurality of PVC porous layers are obtainable by water evaporation of a water-in-oil PVC emulsion; and wherein the pores extend from the PVC layer to the support layer, providing the material breathability, wherein the breathability is at least 0.1 $mg \cdot cm^{-2} \cdot h^{-1}$, the measurement of breathability properties of the layered flexible material was determined by a method based on the standard Water Method (ASTM E96:16) test that evaluates the water vapor transfer through the PVC leather, and on the Water Vapor Absorption Determination Method ISO 17229:16.

In an embodiment, the PVC porous layer or the plurality of PVC porous layers further comprise a pigment, a plasticizer, a stabilizer, anti-aging agents, a filer, a flame retardant, auxiliary substances, UV stabilizers, or mixtures thereof.

In an embodiment, the material described in the present disclosure further comprise an external water permeable lacquer layer over the PVC porous layer or over the plurality of PVC porous layers. The external lacquer layer may comprise polymers comprising one of the following functional groups: hydroxyl, amine, carboxylic, carbonyl, ester, sulphonyl, amide, acrylate, ester, carbonate, or combinations thereof; and comprising at least one hydrophilic functional group.

In an embodiment, the formulation of the water permeable lacquer comprises binders such as Polyurethane, acrylic, vinyl or hybrids resins or the combination thereof, and additives, such as rheology modifiers, defoamers, levelling agents, hand modifiers, matting agents, UV stabilizers, crosslinkers or the combination thereof.

In an embodiment, the material described in the present disclosure further comprises near infrared-radiation (NIR) reflective pigments, transparent pigments, or mixtures thereof.

In an embodiment, the described material comprises at least 0.1% (wt/wt) of NIR reflective pigments, transparent pigments, or mixtures thereof, preferably between 0.1-20% (wt/wt).

In an embodiment, the water permeable lacquer comprises polymers with one of the following functional groups: hydroxyl, amine, carboxylic, carbonyl, ester, sulfonic, amide, acrylate or combinations thereof.

In an embodiment, the material described in the present disclosure further comprises a foam layer, and/or an adhesive layer between the support layer and the PVC porous layer or a plurality of PVC porous layers.

In an embodiment, the NIR reflective pigments and/or transparent pigments are selected from a list consisting of pigments based on pure metals, in particular aluminium, silver or copper; metal pigments with superficial coatings; multi-layered pigments, in particular iridescent pigments; complex inorganic coloured pigments; organic pigments coated with metal oxides, in particular purple dioxazine, perylene, azo pigments, copper phthalocyanine; or mixtures thereof.

In an embodiment, the NIR reflective pigments and/or transparent pigments are in the external permeable lacquer layer.

In an embodiment, the NIR reflective pigments and/or transparent pigments are in the PVC porous layer, or in the plurality of PVC porous layers.

In an embodiment, the NIR reflective pigments and/or transparent pigments are in the foam porous layer.

In an embodiment, the PVC porous layer or the plurality of PVC porous layers does not comprise polyurethane.

In an embodiment, the breathability of the material described in the present disclosure is at least 0.1 $mg \cdot cm^{-2} \cdot h^{-1}$. In another embodiment, the breathability ranges between 0.1-200 $mg \cdot cm^{-2} \cdot h^{-1}$, more preferably 0.1 to 50 $mg \cdot cm^{-2} \cdot h^{-1}$.

In an embodiment, the PVC porous layer or the plurality of PVC porous layers comprises a porosity of 2 to 50 pores per unit area ($mm^2$) with a pore size distribution between 1 μm to 1 mm.

In another embodiment, the PVC porous layer comprises a porosity of 5 to 50 pores per unit area ($mm^2$) with a pore size distribution between 1 μm to 1 mm.

In an embodiment, 50-80% of the pores of the PVC porous layer or the plurality of PVC porous layers comprises a size of 50 μm-500 μm.

In an embodiment, the surface temperature of the breathable layered flexible material is at least 20% lower, preferably between 20-50% lower than other layered flexible materials used as controls.

In an embodiment, the material disclosed in the present document is flexible, resistant to impact and flexing according to standard VDA 230-225:2014.

The present disclosure also relates to upholsteries, in particular car upholsteries, comprising the material described in the present disclosure.

An aspect of the present disclosure relates to a method for the preparation of the breathable layered flexible material of the present disclosure, the method comprising the following steps: preparing a water-in-oil PVC emulsion by mixing PVC particles, plasticizers and additives with water; pouring the water-in-oil PVC emulsion over a hydrophobic base support by knife-coating; gelling the water-in-oil PVC emulsion to evaporate the water and cure the PVC, to form a PVC porous layer.

In an embodiment, the method for the preparation of the breathable layered flexible material further comprises: pouring a second water-in-oil PVC emulsion over the PVC porous layer; placing a support layer on top of the water-in-oil PVC emulsion, preferably a textile support; gelling the water-in-oil PVC emulsion to evaporate the water and cure the PVC to form a second PVC porous layer; peeling out the hydrophobic base and optionally, flipping over the resulting flexible material; covering the flexible breathable material with a permeable lacquer layer.

In an embodiment, the water-in-oil PVC emulsion has a viscosity ranging between 0.5-25 Pa·s at 20° C. In another embodiment, the water-in-oil PVC emulsion further comprises a near infrared-radiation reflective pigment, a transparent pigment, plasticizers, stabilizers, anti-aging agents, fillers, flame retardants, pigments or mixtures thereof.

In an embodiment, the hydrophobic base is a coated paper, a casting and release paper, a release paper, an adhesive tape, or combinations thereof. In a further embodiment, the hydrophobic base comprises a hydrophobic coating, preferably a silicone coating.

BRIEF DESCRIPTION OF THE DRAWINGS

The following figures provide preferred embodiments for illustrating the description and should not be seen as limiting the scope of invention.

DETAILED DESCRIPTION

Figure 1:
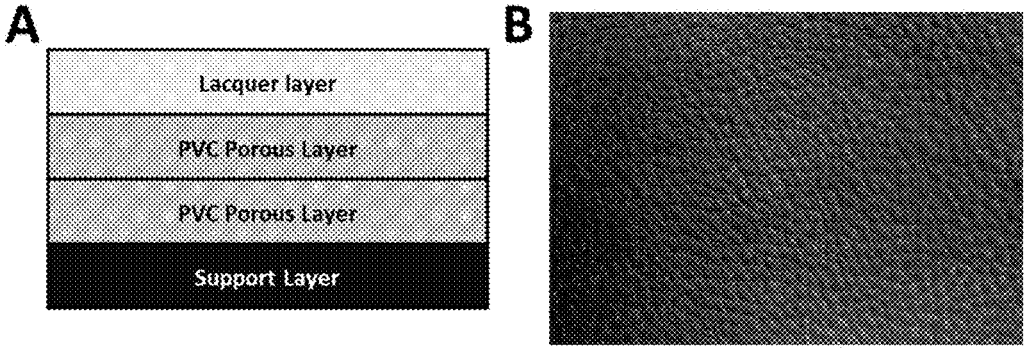
FIG. 1—illustrates a schematic representation (A) and a picture (B) of an embodiment of a version 1 of breathable flexible material of the present disclosure.

The present disclosure relates to a breathable layered flexible material comprising at least one polyvinyl chloride (PVC) porous layer or a plurality of PVC porous layers; and a support layer; wherein the pores of said PVC porous layer or plurality of PVC porous layers are obtainable by water evaporation of a water-in-oil PVC emulsion; and wherein the pores extend from the PVC layer to the support layer providing the material breathability. The disclosure also relates to the method of preparing said breathable flexible layered material. Upholsteries, in particular car upholsteries, comprising the breathable layered flexible material are also disclosed.

The present disclosure also relates to a flexible and breathable layered material, namely a multi-layered artificial leather comprising at least one lacquer layer; at least one intermediate PVC porous layer or a plurality of intermediate PVC porous layers; and a support layer consisting of a textile substrate with the required moisture and water retention characteristics to provide the greatest comfort to the user. In a further embodiment, NIR reflective and/or transparent pigments can be incorporated within the different layers of the product (lacquer and/or porous PVC layers) in substitution of common pigments (without the reflective or transparent characteristics mentioned). The presence of said NIR reflective and/or transparent pigments reduces the surface temperature thus enhancing the thermal comfort for the passenger.

In an embodiment, NIR reflective and/or transparent pigments can be selected from a list consisting of pigments based on pure metals, in particular aluminium, silver or copper; metal pigments with superficial coatings; multi-layered pigments, in particular iridescent pigments; complex inorganic coloured pigments; organic pigments coated with metal oxides, in particular purple dioxazine, perylene, azo pigments, copper phthalocyanine; or mixtures thereof.

In an embodiment, the porous structure within the PVC intermediate layer is produced by the addition of a defined percentage of water to the PVC plastisol. In an embodiment, the obtained PVC plastisol has to be mixed in highly controlled conditions in order to breakdown the water droplets into smaller droplets with the desired size, shape and number, and to spread said drops uniformly in the PVC paste.

In an embodiment, the addition of water must be as slow as possible in order to allow the best possible dispersion in the paste. The plastisol viscosity at the shear rates provided by the mixer plays a significant role in the mixing conditions and mainly in the distribution and size of the water droplets. It is desirable that plastisol viscosity is low enough to provide a good dispersion of the water and the controlled breakdown of the droplets, but high enough to prevent that the mixing is done at very turbulent conditions, which makes it very hard to control the process. The desired viscosity can be achieved with the selection of the PVCs with the adequate particle size distribution and with the addition of a certain percentage of the PVC only after the above-mentioned process of mixing.

Surprisingly, beside the production of the two-phase paste with emulsifiers it was also possible to produce the two-phase paste without the need of any emulsifiers, because the long-term stability of the emulsion can be provided with the right level of low shear rate viscosity.

In an embodiment, the lacquer layer should have a suitable hydrophilicity to allow a more efficient diffusion of water vapour and liquid water through its thickness.

In another embodiment, the textile layer is a layer of fabric, of nonwoven fabric, of technical textile, of knitted fabric or combinations thereof. To increase the moisture transmission through the structural channels, a textile layer (support layer) with improved water management can be used. The yarn(s) may contain a single type of fibre, or be a blend of various types, combining synthetic fibres (which can have high strength, and fire retardant qualities) with natural fibres (which have good water absorbency and skin comforting qualities). The combination of hydrophilic and hydrophobic fibres should be such that it should be able to absorb water easily without sacrificing the dimensional stability in water. The hydrophobic fibres can be a continuous filament or a staple fibre or texturized thread and selected from the following list: polyethersulfone (PES), and/or polypropylene (PP), and/or any type of synthetic fibre. The hydrophilic fibre can be synthetic or natural, ring spun fibres or continuous filament or texturized thread and selected from the following list: cotton, viscose, modal, Lyocell, wood, PES or their mixtures.

Besides water retention, the textile layer also has to be able to allow evaporation of the water retained, so the artificial leather would not be soaked for too long, making it uncomfortable for the user. The yarn structure, being the building block of the fabric, determines the fibre arrangement which is fundamental to water management performance.

In an embodiment, all the layers have to be specifically chosen to present the required characteristics so that the final product can provide the greatest possible comfort to the final user.

The advantages of the present disclosure are that the process to produce breathable films based on this kind of raw material are more ecological (less toxicity) and economical; the lightweight characteristics of the final product; the high degree of functional properties (breathability and moisture management) achieved with this invention and the surprising maintenance of the product's mechanical properties.

Example 1—Preparation of Version 1 of the Layered Breathable and Flexible Material of the present disclosure (FIG. 1)

In an embodiment, the breathable and flexible artificial leather material described in the present example (FIG. 1) comprises multiple layers of different chemical composition (for example with different additives or different molecular weight). The inner surface layer of the material has a textile (support layer) that is covered by two intermediate porous polyvinyl chloride (PVC) layers and one finishing transparent layer (lacquer) of other polymeric nature (polyurethane). The set formed with textile and PVC layers is, from now on, designated as "PVC semi-manufacture". Both PVC layers comprise or consist of PVC powder, plasticizers, stabilizers, anti-aging agents, fillers, flame retardants, auxiliary substances, and pigments such as carbon black or titanium dioxide.

In an embodiment, the composition of FIG. 1 does not contain any chemical foaming agent. FIG. 1-B depicts the final aspect of the composition obtained.

In an embodiment, the plasticizers can be selected from phthalates, adipates, sebacates, citrates, 1,2-cyclohexanedicarboxylic acid diisononyl esters, non-aromatic cyclic ester compounds such as DINCH, dioctyl terephthalate (DOTP), epoxy plasticizers, oligoglycol or polyethylene glycol-based plasticizers, castor oil-based plasticizers and phosphate plasticizers, Brominated plasticizers, sulfate plasticizers, polymeric plasticizers, ionic liquids or mixtures thereof.

In another embodiment, the stabilizers can be selected from barium, calcium, cadmium, tin, lead, antimony, thiols or mercaptans, phosphites or phosphates, SOM, zinc, magnesium and/or phenolics, UV stabilizers, nano-titanium oxides, β-diketones, epoxy-based, perchlorate-based stabilizers and/or amine-based stabilizers, or mixtures thereof. In a further embodiment, the UV stabilizers can be selected from one or more members of the groups consisting of benzotriazole or hindered amine light stabilizers.

In another embodiment, the fillers can be selected from calcium carbonate, silicates, barium sulfate, celulose, calcium sulfate, barium sulfate, silicon dioxide, aluminium hydroxide, aluminium oxide, zinc oxide, hydrated magnesium silicate and zinc bromide or mixtures thereof.

In another embodiment, the flame retardants can be selected from antimony oxide, aluminium oxide, hydrotalcide, alumina Trihydrate, magnesium hydroxide, magnesium carbonate, calcium carbonate, zinc borate, various phosphates such as ammonium phosphate, expandable graphite and brominated and chlorinated plasticizers or mixtures thereof.

In an embodiment, the auxiliary substances can be selected from viscosity aids, adhesion promoters, or mixtures thereof.

In another embodiment, the pigments can be selected from organic but also inorganic pigments, metal pigments, metal pigments with superficial coatings, multi-layered pigments, in particular iridescent pigments; complex inorganic colored pigments; organic pigments coated with metal, or mixtures thereof.

In an embodiment, the production of the material comprises three sequential steps:

1. Production of different PVC fluid pastes (plastisol) for each PVC layer by mixing the plastisol's components, namely PVC powder, plasticizers, stabilizers, kickers, anti-aging agents, fillers, flame retardants, pigments, additives or mixtures thereof. Said components were mixed simultaneously with slow addition of water in order to create water droplets, thus forming a water-in-oil emulsion. In an embodiment, the water-to-oil ratio ranges from 1/10 to 1/1, preferably 1/8 to 1/2. The water-in-oil ratio was obtained considering that the oil corresponds only to the plasticizer and stabilizer fractions.
2. Production of the semi-manufacture PVC through coating, with successive deposition of the plastisol mixtures prepared beforehand, on a hydrophobic base in a continuous form. In an embodiment, the hydrophobic base is a casting and release paper. Each plastisol paste is sequentially spread with the aid of a knife/blade. Between applications, the plastisol undergoes a gelling process inside an oven at 200±5° C. for 1 minute. Then, the textile (support layer) is applied on top of the uncured second plastisol layer and the resulting set undergoes the same gelling process. In an embodiment after, the hydrophobic paper support is removed, and the orientation of the PVC semi-manufacture is flapped.
3. Finishing the PVC semi-manufacture with a water permeable lacquer. The thickness of the water permeable lacquer is no more than 50 μm when applied and preferably at least 15 μm when fully dried. In an embodiment, the water permeable lacquer is preferably a polyurethane lacquer layer. The lacquer layer is spread on top of the PVC that was in contact with the casting and release paper.

For the scope of the present disclosure, a "casting and release paper" is defined as a release paper which imparts patterns and gloss to the surface of resins cured on its surface. In an embodiment, the casting and release paper is coated with a hydrophobic layer, such as silicone, for easy peeling-off.

In an embodiment, the hydrophobic casting and release paper has a maximum width of 242 centimeters and a basis weight of 159 g $m^2$.

Figure 2:
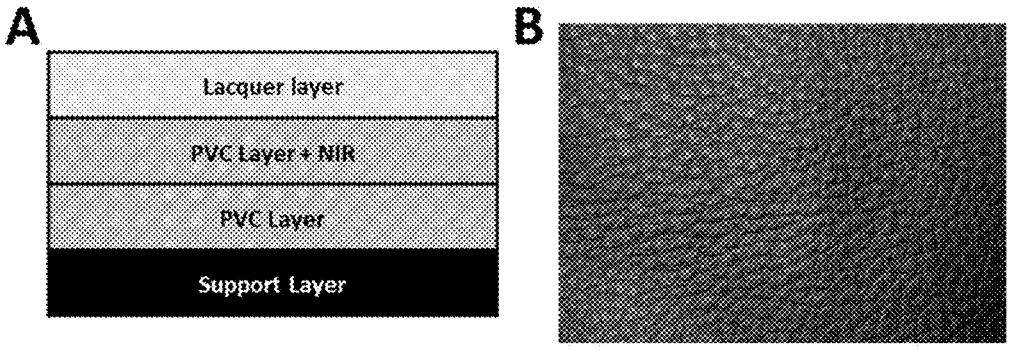
FIG. 2—illustrates a schematic representation (A) and a picture (B) of an embodiment of a version 2 of flexible material of the present disclosure.

Example 2—Preparation of Version 2 of Layered Flexible Material of the Present Disclosure (FIG. 2)

In an embodiment, the flexible artificial leather material described in the present example (FIG. 2) comprises the same number of layers as described in Example 1 but without the addition of water on the PVC fluid paste (plastisol). As a result, the artificial leather obtainable by the present example did not have the breathability and moisture management as observed for the samples obtained in Example 1. Near infrared-radiation reflective pigment (NIR), namely Lumogen® black 0087, were also added to the PVC fluid paste in a concentration ranging from 4 to 8% (w/w).

Figure 3:
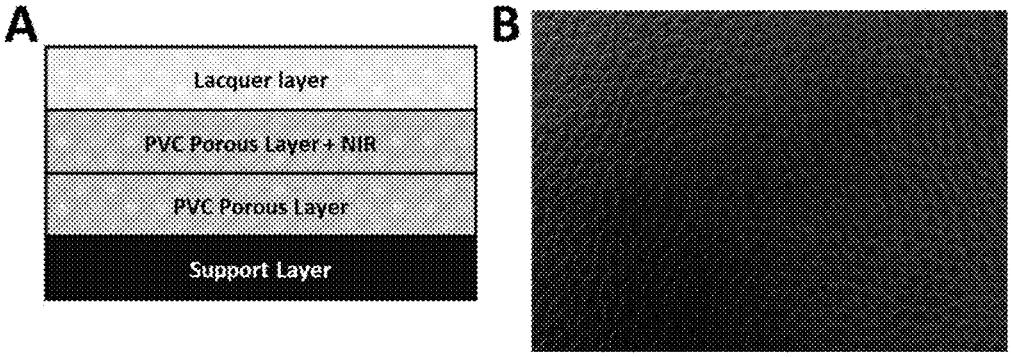
FIG. 3—illustrates a schematic representation (A) and a picture (B) of an embodiment of a version 3 of breathable flexible material of the present disclosure.

Example 3—Preparation of Version 3 of Layered Flexible Material of the Present Disclosure (FIG. 3)

In an embodiment, the breathable and flexible artificial leather material (FIG. 3) was produced following the same steps as described in Example 1. However, the plastisol mixture used to prepare the PVC layer that was directly deposited on the casting and release paper further comprised a near infrared-radiation transparent pigment (Lumogen® black 0087) as described in Example 2.

Figure 4:
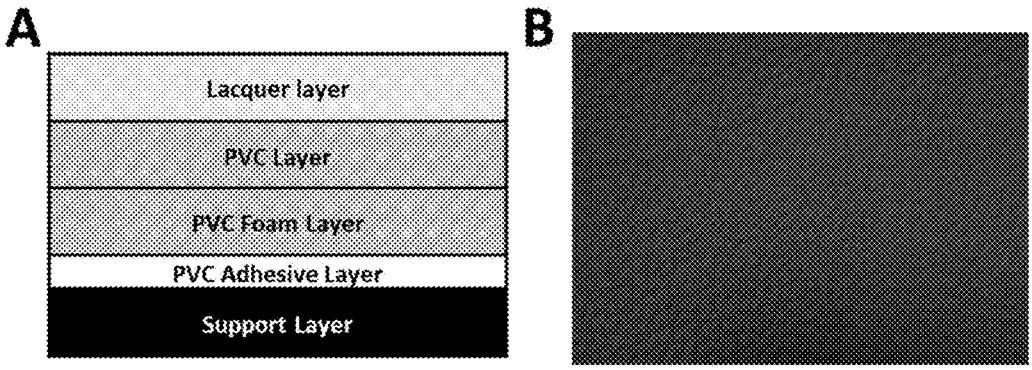
FIG. 4—illustrates a schematic representation (A) and a picture (B) of an embodiment of the control material for comparative data.

Example 4—Description of the Control Material (PVC Standard, Comparative Example, FIG. 4)

The flexible artificial leather material described in the present example (FIG. 4) comprises one extra layer as compared with Example 1, this is an additional adhesive layer. This additional layer is a PVC adhesive layer arranged between the textile support layer and a foam PVC layer. In this example, both adhesive and foam layers contain the same components described in Example 1 (PVC powder, plasticizers, stabilizers, anti-aging agents, fillers, flame retardants, auxiliary substances, pigments, or mixtures thereof) but also a chemical foaming agent, preferably Azodicarbonamide.

In an embodiment, the production of the material also comprises three sequential steps:

1. Production of different PVC fluid pastes (plastisol) for each type of PVC layers (such as foam and adhesive) by mixing plastisol's components, namely PVC powder, plasticizers, stabilizers, anti-aging agents, fillers, flame retardants, pigments, or mixtures thereof, until a good dispersion is achieved. The plastisol solutions used to prepare the foam and adhesive layers further comprises a chemical foaming agent, a kicker, or mixtures thereof.
2. Production of semi-manufacture PVC through coating, with deposition of the three plastisol solutions prepared beforehand, on a hydrophobic paper support, in a continuous form. Each plastisol paste was sequentially spread with the aid of a knife/blade according to the following order: PVC layer, foam layer and adhesive layer. Between applications the plastisol undergoes a gelling process inside an oven at 200±5° C. for 1 minute. Then, the textile is applied on top of the adhesive PVC layer, and the resulting set undergoes the same gelling process.
3. Finishing the PVC semi-manufacture with a lacquer, whose thickness is no more than 50 μm, as in Example 1.

Figure 5:
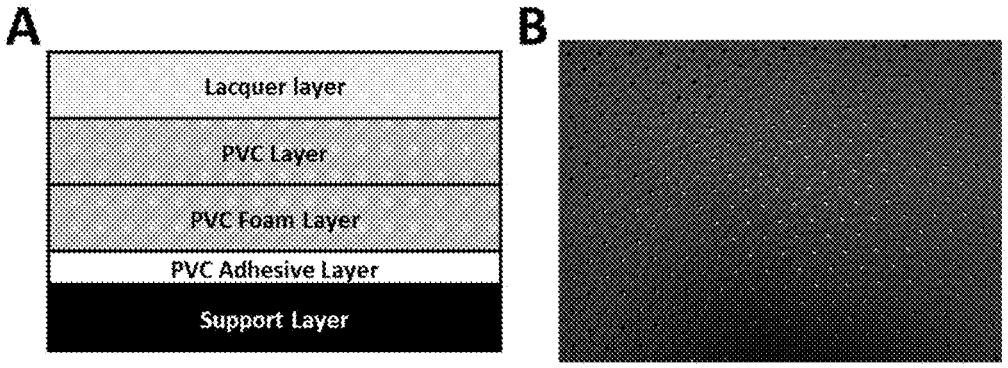
FIG. 5—illustrates a schematic representation (A) and a picture (B) of an embodiment of breathable reference material used for comparative data.

Example 5—Description of the Reference Material (PVC Mechanically Perforated, Comparative Example, FIG. 5)

In an embodiment, a breathable and flexible artificial leather material was produced as described in Example 4 (step 1, 2 and 3), but with an extra final step of mechanical perforation (FIG. 5). The later step was performed to create holes on the surface of the artificial leather material to improve its breathability.

In an embodiment, the measurement of the breathability properties and moisture management of the layered flexible material of the present disclosure was determined by a method based on the standard Water Method (ASTM E96: 16) test that evaluates the water vapor transfer through the PVC leather, and on the Water Vapor Absorption Determination Method ISO 17229. In a further embodiment, a metal cup was filled with 50 ml of distilled water and the tested sample (~78.5 $cm^2$, in triplicate) was placed on the cup leaving a gap to avoid the water contact with the sample. The cup was then sealed to prevent water vapor loss. All the samples were previously weighed and the apparatus (cup+water+sample) was also weighed using an analytical balance. For each test, three complete apparatus and one without sample were placed in a conditioning chamber kept at 32° C. with air being continuously circulated throughout the chamber in order to maintain uniform conditions. After 8 hours, the apparatus and the samples were weighed again. The weight of humidity absorbed by the sample was calculated by the difference between the final and initial sample weight. The absorbed water vapor (Moisture management) was calculated by applying the formula $Awv=w/\pi \cdot r^2$ ($mg \cdot cm^{-2}$), where r is the sample radius value. The permeated water weight was calculated by the difference between the final and initial apparatus weight (wper). The water vapor permeability (Breathability) of the samples was calculated by applying the formula $WVTR=wper/\pi \cdot r^2 \cdot t$ ($mg \cdot cm^{-2} \cdot h^{-2}$), where t is the assay time. The obtained results are listed in Table 1.

In an embodiment, the measurement of the surface temperature reduction of the layered flexible material of the present disclosure was obtained by Infrared (IR) Thermography. The PVC leather was placed in static conditions under a constant environment. The temperature on the top side of the material was measured using an IR camera that produced quantitative data about the thermal conditions of a given area. For all the measurements, the distance between the IR camera and the material surface was the same (approximately 20 cm). The initial surface temperature of the material was set to 25° C. The material was then exposed to an IR emitter (halogen) and the temperature of the heated object was manually recorded with 15 seconds interval during 10 minutes. The temperature variation of the control and tested samples was compared graphically. The surface temperature reduction of each sample was calculated by the difference between the maximum temperature obtained for tested and control samples. The obtained results are listed in Table 1.

In an embodiment, the viscosity of the PVC water-in-oil emulsion was measured using a rotational viscometer. A temperature stabilization of the plastisol sample was done using a thermostabilized water bath at 20±2° C. during 30 minutes. The plastisol was then placed into the cup of the measuring system DIN114 and transferred to the rotational viscometer with coaxial cylinders Rheomat 115. The viscosity measurement was performed under different shear conditions and the values were recorded for each condition with 15 seconds interval, over 30 minutes. During the test, the temperature of the fluid sample was kept constant at 20±2° C.

In an embodiment, the viscosity of the PVC water-in-oil emulsion ranges from 0.5-25 $Pa \cdot s^{-1}$ when using a shear rate of 6.65 $s^{-1}$ to 1008 $s^{-1}$ (MK-DIN 114).

In an embodiment, porosity was evaluated by optical microscopy. The number of pores and pore geometry, size and distribution were determined by image analysis using a software with to estimate these parameters.

TABLE 1

Values of the breathability and surface temperature reduction for the developed material, for the control material (PVC Standard) and for a reference material (PVC mechanical perforated)

| | Control Sample (FIG. 4) | Ref. Material (FIG. 5) | Version 1 (FIG. 1) | Version 2 (FIG. 2) | Version 3 (FIG. 3) |
|---|---|---|---|---|---|
| Weight DIN EN ISO 2286-2(g/m2) | 855 | 855 | 500 | 500 | 500 |
| Thickness DIN EN ISO 2286-3 (mm) | 1.3 | 1.3 | 1.9 | 1.9 | 1.9 |

TABLE 1-continued

Values of the breathability and surface temperature reduction for the developed material, for the control material (PVC Standard) and for a reference material (PVC mechanical perforated)

| | Control Sample (FIG. 4) | Ref. Material (FIG. 5) | Version 1 (FIG. 1) | Version 2 (FIG. 2) | Version 3 (FIG. 3) |
|---|---|---|---|---|---|
| Air permeability ISO 9237 (mm/s) | 0 | 293 | 103 | 0 | 95 |
| Breathability based on ASTM E96 ($mg \cdot cm^{-2} \cdot h^{-1}$) | 0 | 1.6 | 1.5 | 0 | 1.5 |
| Moisture management based on ISO 17229 ($mg \cdot cm^{-2}$) | 0 | 0 | 0.85 | 0 | 0.70 |
| Deformation DIN EN ISO 527-3 warp (%) | 54.77 | 60.59 | 82.67 | — | — |
| Deformation DIN EN ISO 527-3 weft (%) | 132.26 | 217.64 | 141 | — | — |
| Maximum stress DIN EN ISO 527-3 warp (MPa) | 7.73 | 3.54 | 5.05 | — | — |
| Maximum stress DIN EN ISO 527-3 weft (MPa) | 6.37 | 3.3 | 7.62 | — | — |
| Flexing resistance ISO 32100 | 0 | 0 | 0 | — | — |
| Surface temperature reduction | 0 | 0 | 0 | 37.5% | 39.9% |

In an embodiment, the porous PVC layers of the artificial leather of versions 1 and 3 showed a porosity of 2 to 50 pores per unit area ($mm^2$) with a pore size distribution between 1 μm to 1 mm. In a further embodiment, 50-80% of the pores of said PVC porous layers comprised a size ranging from 50 μm to 500 μm.

In an embodiment, from the comparison of the obtained results for the tested samples, it was found that the described combination in versions 3 and 1 showed a higher breathability than the artificial leather used as control sample. Surprisingly, similar breathability values were noticed for these versions and the mechanically perforated artificial leather (reference material, FIG. 5). Air permeability was also higher on versions 1 and 3 as compared to the control sample, but lower than that observed for the reference material. Nevertheless, the air permeability values obtained for versions 1 and 3 show that these versions of artificial leather allow air circulation through its structure, thus being more comfortable to the user.

In an embodiment, the versions of artificial leather that were formed with plastisol solutions comprising water-in-oil emulsions (versions 1 and 3) showed significantly higher values of breathability, air permeability and moisture management as compared to the version fabricated without forming said emulsion (version 2). During gelation, the water droplets comprised in the plastisol water-in-oil emulsions (version 1 and 3) evaporates, and a porous structure is formed within the PVC. Without water (version 2), the plastisol cures as a bulk layer with no porosity, hampering the breathability, air permeability and moisture management of the resulting artificial leather.

In a further embodiment, a surface temperature reduction of 37.5% and 39.9% was achieved for versions 2 and 3, respectively. The observed surface temperature reduction is caused by the presence of NIR pigments in the PVC porous layer beneath the lacquer layer.

Where singular forms of elements or features are used in the specification of the claims, the plural form is also included, and vice versa, if not specifically excluded. For example, the term "a material" or "the material" also includes the plural forms "materials" or "the materials," and vice versa. In the claims articles such as "a," "an," and "the" may mean one or more than one unless indicated to the contrary or otherwise evident from the context. Claims or descriptions that include "or" between one or more members of a group are considered satisfied if one, more than one, or all of the group members are present in, employed in, or otherwise relevant to a given product or process unless indicated to the contrary or otherwise evident from the context. The invention includes embodiments in which exactly one member of the group is present in, employed in, or otherwise relevant to a given product or process. The invention also includes embodiments in which more than one, or all of the group members are present in, employed in, or otherwise relevant to a given product or process.

The term "comprising" whenever used in this document is intended to indicate the presence of stated features, integers, steps, components, but not to preclude the presence or addition of one or more other features, integers, steps, components or groups thereof.

Furthermore, it is to be understood that the invention encompasses all variations, combinations, and permutations in which one or more limitations, elements, clauses, descriptive terms, etc., from one or more of the claims or from relevant portions of the description is introduced into another claim. For example, any claim that is dependent on another claim can be modified to include one or more limitations found in any other claim that is dependent on the same base claim.

Additionally, where the claims recite a composition, it is to be understood that methods of using the composition for any of the purposes disclosed herein are included, and methods of making the composition according to any of the methods of making disclosed herein or other methods known in the art are included, unless otherwise indicated or unless it would be evident to one of ordinary skill in the art that a contradiction or inconsistency would arise.

Where ranges are given, endpoints are included. Furthermore, it is to be understood that unless otherwise indicated or otherwise evident from the context and/or the understanding of one of ordinary skill in the art, values that are expressed as ranges can assume any specific value within the stated ranges in different embodiments of the invention, to the tenth of the unit of the lower limit of the range, unless the context clearly dictates otherwise. It is also to be understood that unless otherwise indicated or otherwise evident from the context and/or the understanding of one of ordinary skill in the art, values expressed as ranges can assume any subrange within the given range, wherein the endpoints of the subrange are expressed to the same degree of accuracy as the tenth of the unit of the lower limit of the range.

The disclosure should not be seen in any way restricted to the embodiments described and a person with ordinary skill in the art will foresee many possibilities to modifications thereof.

The embodiments described above are combinable.

The following claims further set out particular embodiments of the disclosure.

The invention claimed is:

1. A breathable layered flexible material comprising a plurality of polyvinyl chloride (PVC) porous layers wherein the plurality of PVC porous layers comprises multiple layers having different chemical compositions;

a support layer; and an external water permeable lacquer layer over the plurality of PVC porous layers; and at least 0.1 (wt/wt) of NIR reflective pigments, transparent pigments, or mixtures thereof, wherein the NIR reflective pigments and/or the transparent pigments are in the external permeable lacquer layer, or in the plurality of PVC porous layers;

wherein the pores of said plurality of PVC porous layers are obtainable by water evaporation of a water-in-oil PVC emulsion, wherein the pores extend from the PVC porous layers to the support layer providing the material breathability, wherein the breathability is in a range of 50 to 200 $mg \cdot cm^2 \cdot h^{-1}$, and wherein the measurement of breathability properties of the layered flexible material is determinable by a method based on the standard Water Method (ASTM E96: 16) test that evaluates the water vapor transfer through the PVC leather and on the Water Vapor Absorption Determination Method ISO 17229:16;

wherein the plurality of PVC porous layers comprises a porosity of 2 to 50 pores per unit area ($mm^2$) with a pore size distribution between 1 μm to 1 mm;

wherein the plurality of PVC porous layers does not comprise polyurethane.

2. The material according to claim 1, wherein the plurality of PVC porous layers further comprises a plasticizer, a stabilizer, a filler, a flame retardant, auxiliary substances, UV stabilizers, or mixtures thereof.

3. The material according to claim 1, further comprising a foam layer, and/or an adhesive layer between the support layer and the plurality of PVC porous layers.

4. The material according to claim 1, wherein the NIR reflective pigments and/or transparent pigments are selected from the group consisting of: pigments based on pure metals; metal pigments with superficial coatings; multi-layered pigments; complex inorganic coloured pigments; organic pigments coated with metal oxides; and mixtures thereof.

5. The material according to claim 4, wherein the NIR reflective pigments and/or transparent pigments comprise a pure metal selected from the group consisting of: aluminum, silver and copper.

6. The material according to claim 4, wherein the organic pigments are coated with metal oxides selected from the group consisting of: purple dioxazine, perylene, azo pigments, and copper phthalocyanine.

7. The material according to claim 1, wherein the plurality of PVC porous layers comprises a porosity of 5 to 50 pores per unit area ($mm^2$) with a pore size distribution between 1 μm to 1 mm.

8. The material according to claim 1, wherein 50-80% of the pores of the plurality of PVC porous layers comprises a size of 50 μm-500 μm.

9. An upholstery for a car comprising the material of claim 1.

10. The material according to claim 1, wherein the material comprises a range of between 0.1 to 20% (wt/wt) of NIR reflective pigments, transparent pigments, or mixtures thereof.

* * * * *